US009433257B2

(12) United States Patent
Taetzsch

(10) Patent No.: US 9,433,257 B2
(45) Date of Patent: Sep. 6, 2016

(54) MAGNETIC ATTACHMENT DEVICE FOR RELEASABLY ATTACHING AN ARTICLE TO A BUTTON

(71) Applicant: Roy S. Taetzsch, Princeton, NJ (US)

(72) Inventor: Roy S. Taetzsch, Princeton, NJ (US)

( * ) Notice: Subject to any disclaimer, the term of this patent is extended or adjusted under 35 U.S.C. 154(b) by 214 days.

(21) Appl. No.: 14/310,749

(22) Filed: Jun. 20, 2014

(65) Prior Publication Data

US 2015/0366297 A1 Dec. 24, 2015

(51) Int. Cl.

| | |
|---|---|
| ***A44B 1/14*** | (2006.01) |
| ***A41F 1/00*** | (2006.01) |
| ***A44B 6/00*** | (2006.01) |
| ***A44B 1/04*** | (2006.01) |
| *A41D 25/02* | (2006.01) |

(52) U.S. Cl.

CPC ..... *A44B 1/04* (2013.01); *A41D 25/027* (2013.01); *A44D 2203/00* (2013.01); *Y10T 24/1934* (2015.01); *Y10T 24/32* (2015.01); *Y10T 24/367* (2015.01); *Y10T 24/3672* (2015.01)

(58) Field of Classification Search

CPC ..... A44B 1/14; A44B 6/00; A41F 1/002; Y10T 24/1934; Y10T 24/32; Y10T 24/367; Y10T 24/3672; Y10T 24/3694

See application file for complete search history.

(56) References Cited

U.S. PATENT DOCUMENTS

| | | | | | |
|---|---|---|---|---|---|
| 581,111 | A | * | 4/1897 | Goodwin | A44B 1/14 24/113 MP |
| 2,483,031 | A | | 6/1948 | Avedon | |
| 2,592,395 | A | | 4/1952 | Cummings | |
| 2,601,424 | A | | 6/1952 | Baker | |
| 2,751,654 | A | | 6/1956 | Armbruster | |
| 2,975,497 | A | | 3/1961 | Budreck | |
| 3,141,216 | A | | 7/1964 | Haskell | |
| 3,161,932 | A | | 12/1964 | Russell | |
| 3,316,601 | A | | 5/1967 | Ryan | |
| 3,343,230 | A | | 9/1967 | Darvie | |
| 3,353,231 | A | | 11/1967 | Levine | |
| 3,499,192 | A | | 3/1970 | Holtz | |
| 3,584,349 | A | | 6/1971 | Schubart | |
| 3,777,336 | A | * | 12/1973 | Anderson | A44B 1/14 24/113 MP |
| 3,827,019 | A | | 7/1974 | Serbu | |
| 3,934,313 | A | | 1/1976 | Hocq | |
| 4,399,595 | A | | 8/1983 | Yoon et al. | |
| 4,539,731 | A | | 9/1985 | Torrini | |
| 5,007,139 | A | | 4/1991 | Ahem | |
| 5,050,276 | A | | 9/1991 | Pemberton | |
| 5,060,356 | A | | 10/1991 | Szedzinski | |
| 5,161,285 | A | | 11/1992 | Jerjian | |
| 5,337,584 | A | * | 8/1994 | Angeli | A44B 1/14 24/113 R |
| 5,394,719 | A | * | 3/1995 | Fang | A44B 1/14 24/113 MP |
| 5,621,951 | A | * | 4/1997 | Gould | A44B 1/14 24/113 MP |
| 5,732,451 | A | | 3/1998 | Mars | |
| 6,216,275 | B1 | | 4/2001 | Lee | |
| 6,282,760 | B1 | | 9/2001 | Mars | |

(Continued)

*Primary Examiner* — Robert J Sandy

(57) ABSTRACT

A magnetic attachment device for releasably attaching an article to a button on shirts, blouses, and the like. The magnetic attachment device contains: (a) a button cover for a button secured to an article, the cover contains a cap having an unobstructed interior and an open side for receiving a button therein, and a closure plate rotatably attached to the cap about a rotational axis between an opened and closed position with respect to the open side of the cap, wherein the button cover contains a magnetic member; and (b) an article containing a magnetic member, wherein upon contacting the magnetic member of the article and the magnetic member of the button cover provides a magnetically attractive force which is sufficient to attach the article to the button cover.

19 Claims, 6 Drawing Sheets

(56) References Cited

U.S. PATENT DOCUMENTS

| | | | | |
|---|---|---|---|---|
| 6,857,167 | B2 * | 2/2005 | Bishop | A41D 25/003 24/113 MP |
| 7,350,274 | B2 * | 4/2008 | Rogers | A42B 1/24 24/113 MP |
| 7,640,636 | B2 | 1/2010 | Clark | |
| 7,735,336 | B2 | 6/2010 | Williams | |
| 7,992,264 | B2 | 8/2011 | Abadi | |
| 8,615,853 | B2 | 12/2013 | Rathbun | |
| 8,646,971 | B2 | 2/2014 | Doyle | |
| 8,936,222 | B1 | 1/2015 | Bastian | |
| 7,571,623 | B2 | 2/2015 | Fonzo | |
| 2012/0117763 | A1 | 5/2012 | Patel | |
| 2012/0324678 | A1 | 12/2012 | Dronia | |
| 2014/0101819 | A1 * | 4/2014 | Ike | A41D 25/003 2/145 |
| 2015/0047105 | A1 | 2/2015 | Fonzo | |

* cited by examiner

MAGNETIC ATTACHMENT DEVICE FOR RELEASABLY ATTACHING AN ARTICLE TO A BUTTON

FIELD OF THE INVENTION

The described embodiments generally relate to clothing. More particularly, the present embodiments describe a magnetic attachment device for releasably attaching an article to a button.

BACKGROUND OF THE INVENTION

Button covers have been known for quite some time and have taken on a variety of constructions. These known button covers are generally formed from two elements, namely, a cover having an open side for receiving the button and a closure plate for retaining the cover in secured relationship to the button while being worn. Button covers of this type are known from U.S. Pat. Nos. 2,751,654; 3,316,601; 3,343,230; 3,353,231; 3,584,349; 3,934,313; 4,539,731; 5,060,356; and 5,161,285. Such button covers have had traditional application as a decorative accessory for male shirts that when applied over the cuff buttons, simulate the presence of cuff links. In addition, such button covers have been used on women's blouse cuffs, as well as other locations for buttons when desired to produce an aesthetically attractive effect.

Tie clips are used to secure a tie relative to the front of a shirt and typically include a clip having a hinge. The clip is opened and one arm is positioned in front of the tie, while a second arm is inserted into an opening in the front of the shirt that is between the buttons of the shirt. When the clip is closed, the tie is secured to the shirt. One disadvantage of typical tie clips is that the tie can form wrinkles or folds when the individual moves. For example, when an individual sits down, this can cause a large fold because the relative distance between the clip and the individual's neck has decreased.

Thus, there is a need for an attachment device that does not rely on connectors such as mechanical fasteners to attach objects together, especially one that can be used to attached a tie to a button on a shirt, wherein a user may experience the look of wearing a tie without the inconvenience and displeasure afforded by prior art ties which not only constrict movement of the neck but causing the user's neck to be susceptible to sweating and discomfort. Moreover, there is a need for a device which allows a wearer to quickly attach a professional knotted tie without worrying that such tie may get caught in a machine resulting in serious bodily harm to the wearer.

SUMMARY OF THE DESCRIBED EMBODIMENTS

Embodiments described herein relate to a magnetic attachment device for releasably attaching an article to a button. In one embodiment, this is accomplished by incorporating a magnet on or about a button cover and incorporating a metal in an article, such as a tie knot or any other accessory, which when brought into proximity with each other provide a magnetic field. The magnetic field results in the objects magnetically attaching to each other in a desired and repeatable manner. The objects can remain in the magnetically attached state if and until a releasing force of sufficient magnitude is applied that overcomes the overall net attractive magnetic force.

A magnetic attachment device for releasably attaching an article to a button, said magnetic attachment device comprising:

(a) a button cover for a button, said cover comprising a cap having an unobstructed interior and an open side for receiving a button therein, and a closure plate rotatably attached to said cap about a rotational axis between an opened and closed position with respect to said open side of said cap, wherein said button cover comprises a magnetic member; and (b) an article comprising a magnetic member, wherein upon contacting said magnetic member of said article and said magnetic member of said button cover provides a magnetically attractive force which is sufficient to attach said article to said button cover. Preferably, the button is sewn or snapped onto clothing.

A magnetic attachment device for releasably attaching an article to a button, said magnetic attachment device comprising:

(a') a button cover for a button secured to material by a thread-like element, said cover comprising a cap having an unobstructed interior and an open side for receiving a button therein, and a closure plate rotatably attached to said cap about a rotational axis between an opened and closed position with respect to said open side of said cap, said plate including a slot having a longitudinal axis for receiving said thread-like element, said slot opposing said cap when said plate is arranged in said closed position, said plate movable between said opened and closed position by rotation of said plate about said rotational axis in a direction transverse to the longitudinal axis of said slot, wherein said button cover comprises a magnetic member; and (b) an article comprising a magnetic member, wherein upon contacting said magnetic member of said article and said magnetic member of said button cover provides a magnetically attractive force which is sufficient to attach said article to said button cover.

As used herein, "material" refers to any type of clothing, fabric, or substance having at least one button attached thereto. As used herein, "article" refers to any type of decorative clothing or accessory, such as a tie, cufflink, broach, decoration, ribbon, or medal. Thus, the terms "material" and "article" while independently selected may overlap.

In one embodiment of the invention, the magnetic attachment device is used to attach a tie to a shirt having at least one button.

In another embodiment of the invention, the magnetic attachment device is used to attach a cuff link to a shirt having at least one button.

In another embodiment of the invention, the magnetic attachment device is used to attach a broach to a shirt having at least one button.

In another embodiment of the invention, the magnetic attachment device is used to attach an ornamental covering to an article of clothing having at least one button.

In another embodiment of the invention, a magnet is attached to the button cover and the article being attached contains a metal which allows for the article to be magnetically coupled to the magnet.

In another embodiment of the invention, a magnet is disposed on the article and the button cover contains a metal which allows for the article to be magnetically coupled with the button cover.

In another embodiment of the invention, there is disclosed a button cover comprising a cap having an open side for receiving a button therein, and a closure plate movably attached to the cap, the plate including an elongated slot having a longitudinal axis, the plate movable between an opened and closed position with respect to the open side of the cap by movement of the plate in a direction transverse to the longitudinal axis of the slot.

In another embodiment of the invention, there is disclosed a button cover comprising a cap having an open side for receiving a button therein, a closure plate including an elongated slot having a longitudinal axis, the elongated slot communicating at one end with a central opening within the plate and at its other end with an enlarged opening at a peripheral portion of the plate, and connecting means for rotatably connecting the plate to the cap, the plate rotatable between an open position to provide access to an interior portion of the cap for receiving the button therein and a closed position removably secured within the open side of the cap upon rotation of the plate in a direction transverse to the longitudinal axis of the slot.

In another embodiment of the invention, there is disclosed a cover for a button secured to an article by a threadlike element, the cover comprising a cap having an open side for receiving a button therein, and a closure plate movably attached to the cap between an opened and closed position with respect to the open side of the cap, the plate having an elongated slot communicating at one end with an enlarged opening at a peripheral portion of the plate, the opening sized to readily receive the threadlike element while the elongated slot sized to receive the threadlike element in engaged relationship with portions of the plate bounding the elongated slot so as to assist in retaining the plate attached to the threadlike element when the cap is in the open position.

An unexpected advantage of the magnetic attachment device according to the present invention is the convenience and speed of attaching a professional looking tie knot in seconds.

An unexpected advantage of the magnetic attachment device according to the present invention is that the user may experience the look and feel of wearing a tie without the inconvenience and displeasure afforded by standard ties that not only constrict movement of the neck but causing the user's neck to be susceptible to sweating and discomfort.

An unexpected advantage of the magnetic attachment device according to the present invention is that the magnetic attachment device when used to attach a tie to material having a button cover thereon provides a self-centering mechanism for the tie.

An unexpected advantage of the magnetic attachment device according to the present invention is that in the case of a tie, the magnetic attachment device does not cause wrinkles or folds as the wearer moves.

An unexpected advantage of the magnetic attachment device according to the present invention is that because the article can only attach to the button in a specific orientation, the magnetic attachment device assures proper alignment and positioning of the article and the button.

An unexpected advantage of the magnetic attachment device according to the present invention is that in the case of a tie, the tie does not require a tail portion. However, if a tail portion is desired, the tail portion may optionally be used as part of an adjustment mechanism for the front portion of the tie.

An unexpected advantage of the magnetic attachment device according to the present invention is safety. No longer does a wearer of the magnetic attachment device according to the invention, in the case of a tie need to worry about common mishaps leading to serious injury including death. For example, having a standard tie get caught in a machine such as a blender or an escalator often results in death or serious injury to the wearer of the tie. However, in the case of the magnetic attachment device according to the invention, the device is simply removed from the wearer without bringing the wearer in contact with the hazardous machine or escalator.

An unexpected advantage of the magnetic attachment device for releasably attaching an article to a button according to the present invention is aesthetic. For example, in the case of a tie, an unlimited assortment of professional knots are available. Moreover, the wearer can quickly experiment with different ties and choose the right look without having to practice tying a tie for hours to obtain the proper looking tie knot.

BRIEF DESCRIPTION OF THE DRAWINGS

The invention will be readily understood by the following detailed description in conjunction with the accompanying drawings, wherein like reference numerals designate like structural elements, and in which.

Other aspects and advantages of the invention will become apparent from the following detailed description taken in conjunction with the accompanying drawings which illustrate, by way of example, the principles of the described embodiments.

DETAILED DESCRIPTION OF PREFERRED EMBODIMENTS

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Figure 1:
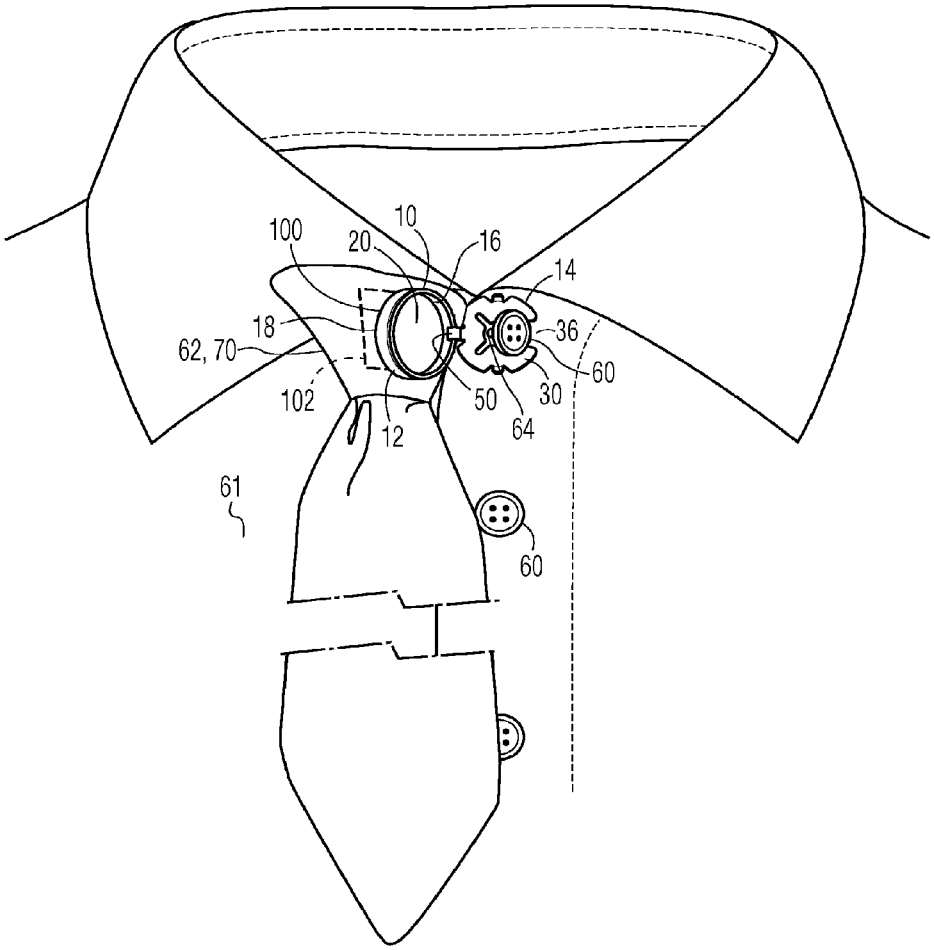
FIG. 1 is a perspective view of a magnetic attachment device in accordance with the present invention showing a button cover in an opened position having a tie attached thereto by means of magnetic members.

Referring now to the drawings, wherein like reference numerals represent like elements, there is shown in FIG. 1 a button cover generally designated by reference numeral 10 and having a tie 70 attached thereto. The button cover 10 is constructed from essentially two elements, namely, a cap 12 and a closure plate 14. The cap 12 is constructed from a cylindrical side wall 16, an end wall 18 and an open side 20 which provides access to the hollow interior 22. The cap 12 is shaped and sized so as to receive a button within the interior 20 as to be described hereinafter. In this regard, the cap 12 may be constructed in other shapes other than cylindrical, such as oval, square and the like. In addition, the end wall 18 may be flat, domed or concaved.

The closure plate 14 is constructed as a generally circular flat disk 30 dimensioned to be received within the open side 20 of the cap 12. The shape of the cap 12 is not limited. The closure plate 14 is provided with a radially oriented slot 32. The closure plate 14 is further provided with a central opening 34 communicating with one end of the slot 32 and an enlarged V-shaped opening 36 communicating with the other end of the slot. The V-shaped opening 36 opens outwardly along the peripheral edge of the closure plate 14.

Figure 2:
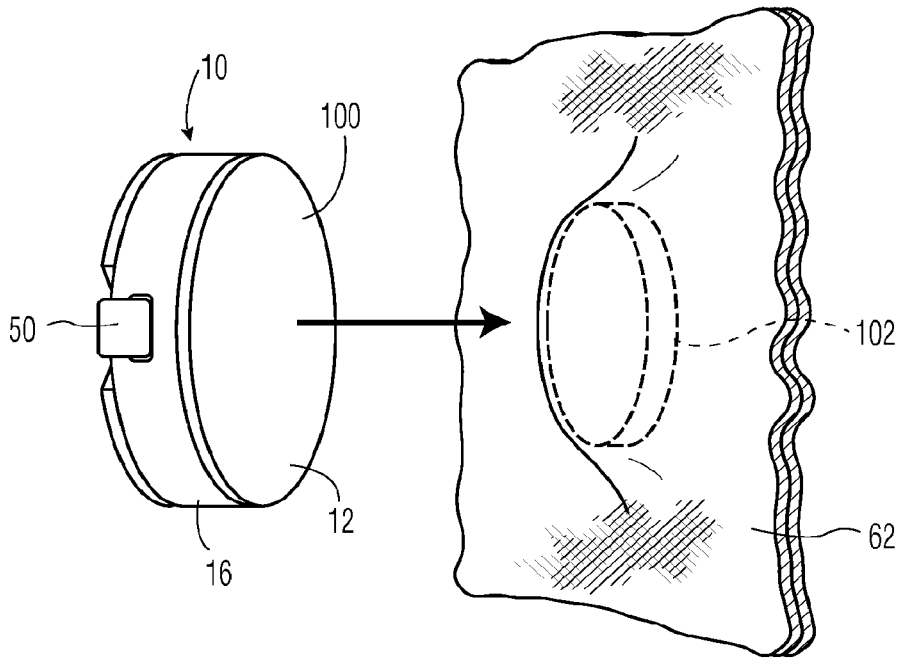
FIG. 2 is a perspective view of a magnetic attachment device in accordance with the present invention showing a button cover in a closed position and a magnet embedded within one of two layers of material.
Figure 5:
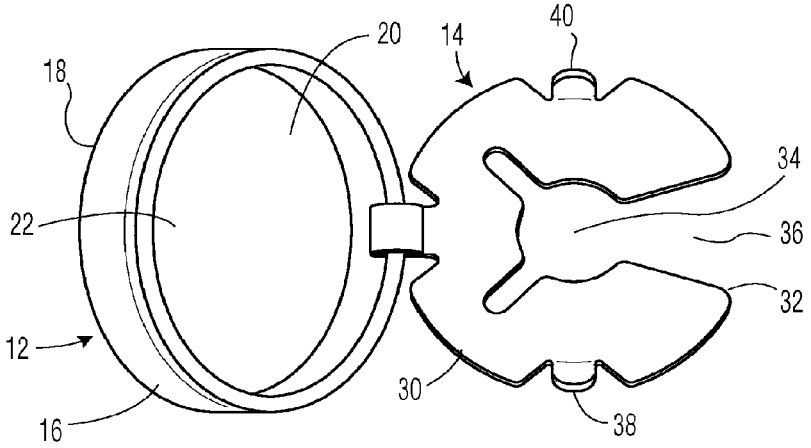
FIG. 5 is an exploded view of a button cover constructed in accordance with the prior art.
Figure 5A:
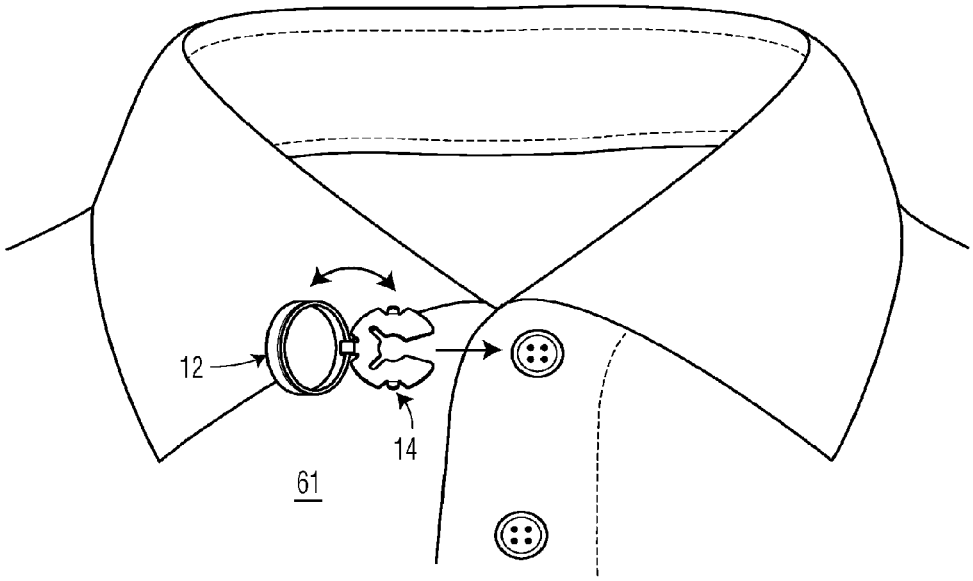
FIG. 5A is a perspective view of a magnetic attachment device in accordance with the present invention showing a button cover in an opened position having a closure plate rotatably attached to a cap by means of a hinge, wherein the closure plate has an elongated slot for receiving threads attaching a button to a shirt.

The closure plate 14 is attached to the cap 12 by means of a hinge 50. The hinge 50 may be intricately formed with or separately attached to the peripheral edge of the closure plate 14. The hinge 50 enables the closure plate 14 to be pivoted or rotated between the opened position as shown in FIG. 1 and FIG. 5, FIG. 5A and in the closed position as shown in FIG. 2.

Two edges of the closure plate 14 is provided with projections 38, 40 extending in a direction perpendicular to the circular flat disk 30 and toward the cap 12. The projections 38, 40, as shown in FIG. 5, extend beyond the extent of the side wall 16 of the cap 12. In addition, the projections 38, 40 are curved or displaced slightly away from the plane containing the remainder of the disk 30. This construction of the projections 38, 40 facilitates opening of the button cover 10 upon engagement with the tips of one's fingers or nails to be described hereinafter.

Figure 3:
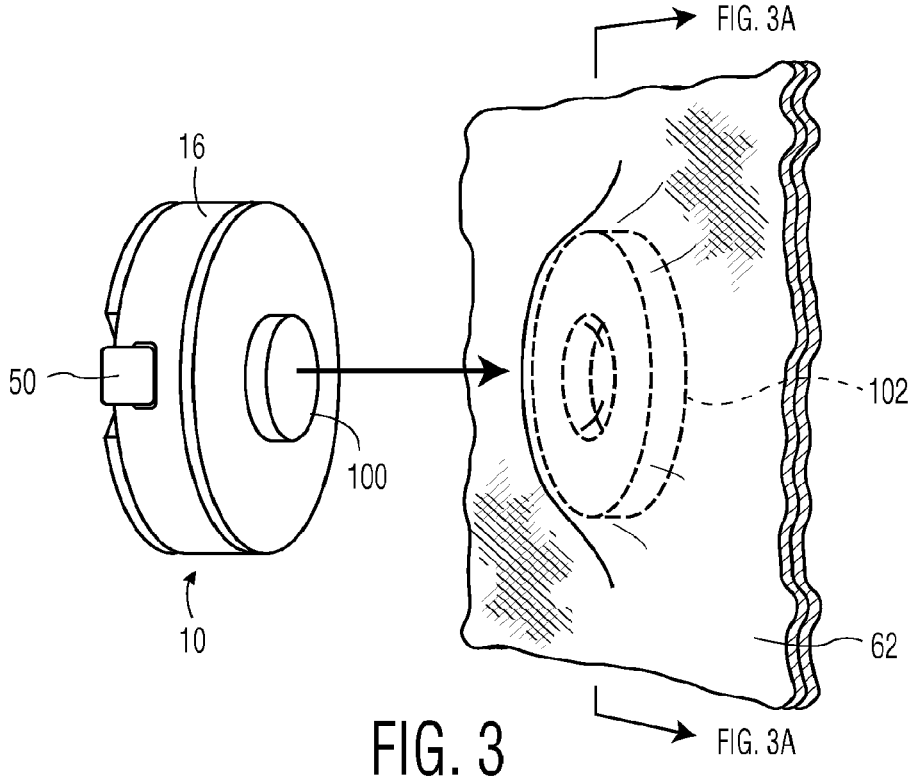
FIG. 3 is a perspective view of a magnetic attachment device in accordance with the present invention showing a button cover having a magnet attached on the outside of the button cover cap wherein said magnet fits within a magnetic member embedded in or attached to an article having two layers of fabric.

A portion of the disk 30 between the projections 38, 40 is bent upwardly in an opposite direction to form a locking element 42. The locking element 42 is constructed to frictionally engage the interior surface of the side wall 16 when the closure plate 14 is arranged in its closed position as shown in FIG. 3. The locking element 42 prevents the cap 12 from being inadvertently opened during use. The locking element 42 although described as being formed from a portion of the disk 16, may be provided as a separate element attached to the disk 30 if desired.

The closure plate 14 is attached to the cap 12 by means of a hinge 50. The hinge 50 may be intricately formed with or separately attached to the peripheral edge of the closure plate 14. The hinge 50 enables the closure plate 14 to be pivoted or rotated between the opened position as shown in FIG. 5 and the closed position as shown in FIG. 3.

The button cover 10 is applied to a button 60 which is secured to an article of clothing 62 by means of a plurality of button fastening threads 64 as is conventional. With the button cover 10 in an open position as shown in FIG. 1, the closure plate 14 is slid between the button 60 and article 62 wherein the article 62 is clothing 61. The threads 64 are accommodated by the closure plate 14 by first being aligned with and readily received by the V-shaped opening 36. As the closure plate 14 is further slid under the button 60 the threads 64 are received within the slot 32 and finally by the opening 34. The slot 32 is constructed to be relatively narrow so as to frictionally engage the threads 64 requiring that a slight amount of force be applied during insertion and removal of the closure plate 14. By sizing the width of the slot 32 to be generally narrower than the dimensions of the threads 64, this has the tendency of preventing the button cover 10 from being dislodged from a button 60 upon inadvertent opening of the cap 12. This restricted opening of the slot 32 also assists in keeping the button cover 10 in place when worn by preventing play with the button fastening threads 64. The cap 12 is closed and locked in position covering the button 60 upon rotation about hinge 50 until the locking element 42 is frictionally engaged by the interior surface of the side wall 16.

The button cover 10 may be removed by initially engaging the projections 38, 40 with the tip of one's finger or nails and rotating the cap 12 about hinge 50. The button cover 10 may then be removed by sliding the closure plate 14 from between the button 60 and article 62 in the placement direction along the longitudinal axis of the slot 32. As previously described, a slight force will be required due to the restrictive nature of the slot 32 with respect to the threads 64 securing the button 60.

There is shown in FIG. 2 a button cover generally designated by reference numeral 10. The button cover 10 is shown in the closed position. The cap 12 is constructed from a cylindrical side wall 16. The cap 12 is made of steel and thus serves as a magnetic member 100. An article 62 is also shown in FIG. 2 having a magnetic member 102.

There is shown in FIG. 3 a button cover generally designated by reference numeral 10. The button cover 10 is shown in the closed position. The cap 12 is constructed from a cylindrical side wall 16. The cap 12 has a magnet attached as a protrusion on the outside of the button cover cap 12. The magnet serves as a magnetic member 100. An article 62 is also shown in FIG. 3 having a magnetic member 102 which is made of steel and shaped to receive the magnetic member 100.

The magnetic members 100 and 102 are not particularly limited and can be any material that can be used to form a magnetically attractive force sufficient to couple the magnetic member 100 and magnetic member 102. The magnetic members may be prepared from the same materials or different materials. Any material that can be used to form a magnetically attractive force sufficient to couple or attach the magnetic member 100 with the magnetic member 102 is suitable. The magnetic members are independently selected from ferromagnetic materials, paramagnetic materials, and combinations thereof. The magnetic members can be selected to form a corresponding magnetic attraction. For example, the magnetic member 100 may be a ferromagnetic material that provides a magnetically attractive force which is sufficient to attach to the magnetic member 102.

In addition to the magnetic members being prepared from materials that form a magnetically attractive force, the magnetic member may be attached to magnetically inactive materials such as plastic and cardboard, or non-magnetic metal such as copper, lead, zinc, and aluminum.

In some embodiments, a magnetic member 102 is incorporated in or affixed to the button cover 10. For example, the button cover cap 12 may include a paramagnetic or ferromagnetic material that allows magnetic coupling with the magnetic material 100 that is present in an article 62. In other embodiments of the invention, the magnetic member 100 may be attached, affixed, embedded in or embedded on the button cover cap 10 and the magnetic member 102 may be attached, affixed, embedded in or embedded on the article 62, or vice versa. The article 62 is preferably clothing such as a tie or cufflink or an accessory.

In one embodiment, the magnetic member 100 is a magnet and the magnetic member 102 is a material, such as steel, iron, nickel, cobalt, tin, gadolinium, and the like, including alloys thereof, that can be magnetically coupled with a magnet. For example, the magnetic member 102 may be a thin steel plate that is magnetically attracted to a magnet.

As used within the present invention, a magnetic preferably has a weight of between about 5 grams (g) and about 200 g. More preferably, a magnet has a weight of between about 10 grams and about 50 g.

In some embodiments, the magnetic member 100 includes a ferromagnetic material that can be magnetically coupled with a paramagnetic material and/or ferromagnetic material on the magnetic member 102. For example, the magnetic member 100 could include a ferromagnetic material configured to be magnetically coupled with the ferromagnetic material on the magnetic member 102 (e.g., configured so that opposing poles face each other).

Ferromagnetic materials can be divided into magnetically "soft" materials like annealed iron, which can be magnetized but do not stay magnetized, and magnetically "hard" materials, which do. Permanent magnets are made from "hard" ferromagnetic materials such as alnico and ferrite that are subjected to special processing in a powerful magnetic field during manufacture, to align their internal microcrystalline structure, making them very hard to demagnetize. Preferably, the magnet is a neodymium magnet.

Figure 4:
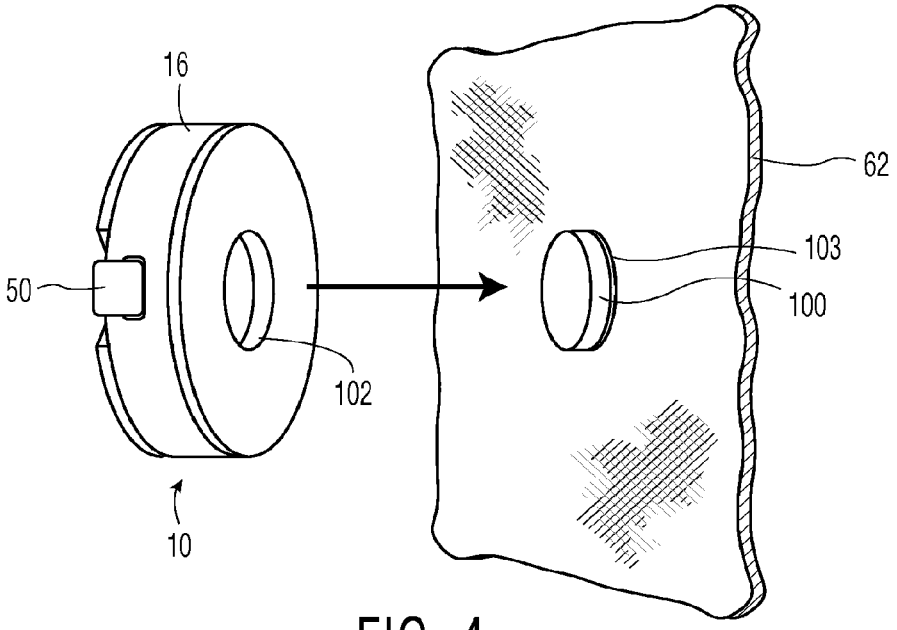
FIG. 4 is a perspective view of a magnetic attachment device in accordance with the present invention showing a button cover having a button cover cap prepared from a magnetically attractive metal, wherein the cap contains an indentation therein, and a material having a magnet adhesively attached as a protrusion thereon.

The magnetic member 100 and magnetic member 102 may have various shapes. In some embodiments, the magnetic member 102 may include a female engaging portion as shown in FIG. 4 that accommodates physical coupling with a male engaging portion as shown in FIG. 4 on the magnetic member 100. As an example, the female engaging portion of the magnetic member 102 may be a metal plate having a rounded indentation in its center. The indentation may generally correspond to a rounded protrusion which extends outward from the magnetic member 100 which is the male engaging portion. The rounded protrusion may be a magnet itself. Thus, upon magnetic coupling, the male engaging portion on the magnetic member 100 may fit within the rounded indentation on the magnetic member 102, which may result in improved coupling (e.g., a stronger attractive force). Using similar principles, the male engaging portion could be included on the magnetic member 100, while the magnetic member 102 may have the corresponding female engaging portion as shown in FIG. 3.

Figure 3A:
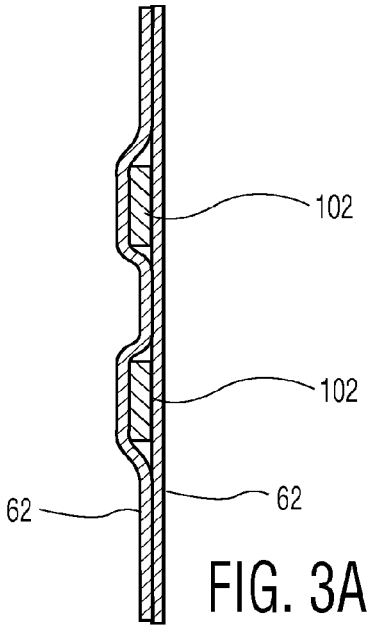
FIG. 3A is a cross-section view of a magnetic attachment device shown in FIG. 3 along the line 3A-3A.

With reference to the drawings, FIG. 3A is a cross-section view of a magnetic attachment device shown in FIG. 3 along the line 3A-3A.

There is shown in FIG. 4 a button cover generally designated by reference numeral 10. The button cover 10 is shown in the closed position. The cap 12 is constructed from a cylindrical side wall 16. The cap 12 is made of steel and thus serves as a magnetic member 102. The cap 12 is shaped to receive the magnetic member 100. An article 62 is also shown in FIG. 4 having magnetic member 100 shaped to fit within magnetic member 102.

There is shown in FIG. 5 a button cover generally designated by reference numeral 10. The button cover 10 is constructed from essentially two elements, namely, a cap 12 and a closure plate 14. The cap 12 is constructed from a cylindrical side wall 16, an end wall 18 and an open side 20 which provides access to the hollow interior 22. The cap 12 is shaped and sized so as to receive a button within the interior 20 as to be described hereafter. In this regard, the cap 12 may be constructed in other shapes other than cylindrical, such as oval, square and the like. In addition, the end wall 18 may be flat, domed or concaved.

With reference to the drawings, FIG. 5A is a perspective view of a magnetic attachment device in accordance with the present invention showing a button cover 10 in an opened position having a closure plate 14, wherein the closure plate 14 has an elongated slot 36 for receiving threads 64 attaching a button 60 to material 61 which in this embodiment is a shirt.

In some embodiments, a magnetic member 10 and/or magnetic member 102 are integrated with a tie 70. For example, a tie 70 may include a magnetic member stitched within the tie 70. The magnetic member may then be magnetically coupled with the magnetic member on a button cover 10. The button cover 10 is applied to a button 60 which is secured to a material such as clothing 61 by means of threads 64.

Figure 6:
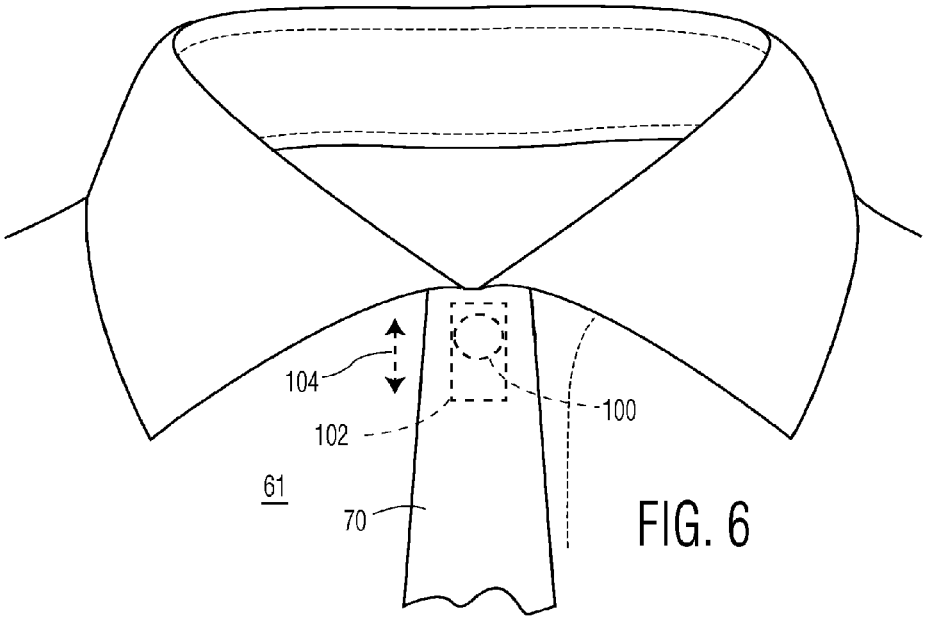
FIG. 6 is a simplified perspective view of a magnetic attachment device in accordance with the present invention showing a knotless tie adjustably attached to a shirt.
Figure 7:
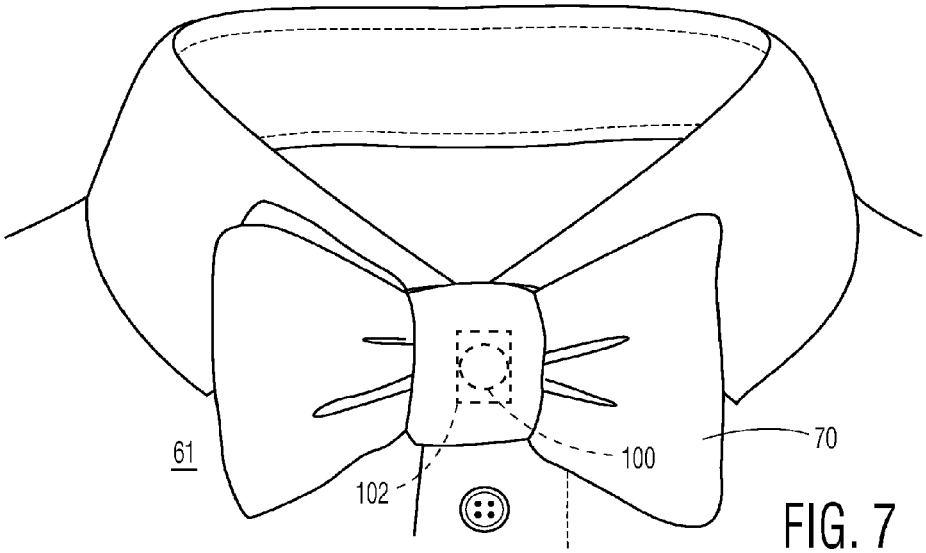
FIG. 7 is a simplified perspective view of a magnetic attachment device in accordance with the present invention showing a bow tie attached to a shirt.
Figure 8:
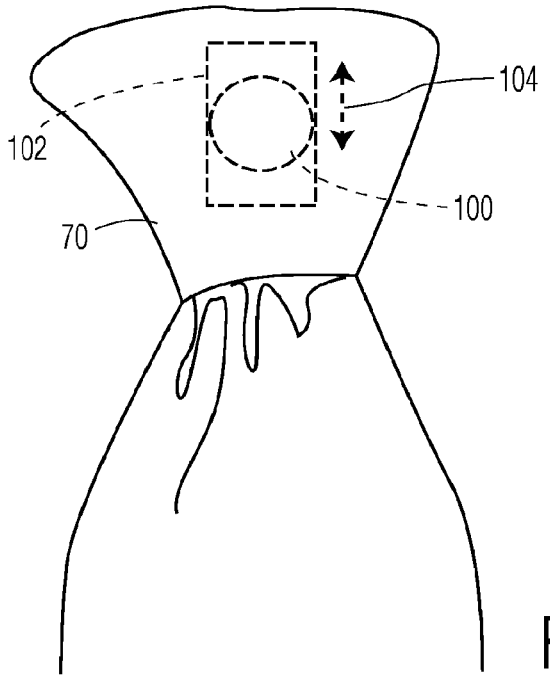
FIG. 8 is a simplified perspective view of a magnetic attachment device in accordance with the present invention showing a simulated tie knot having a magnetic member attached thereto.
Figure 9:
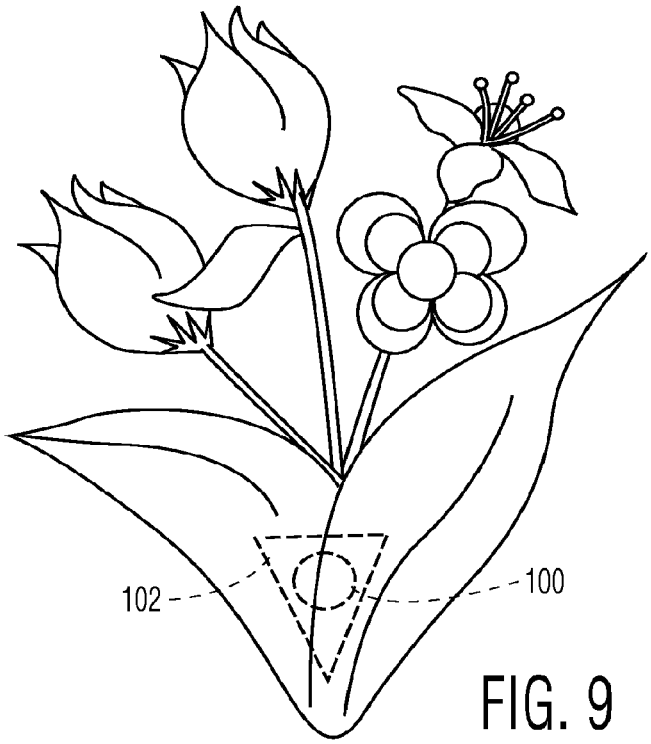
FIG. 9 is a simplified perspective view of a magnetic attachment device in accordance with the present invention showing a broach having a magnet member attached thereto.

One or more examples of articles incorporating the magnetic attachment device as disclosed in the present invention are illustrated in FIG. 6, FIG. 7, FIG. 8, and FIG. 9. More specifically, FIG. 6 shows a tie attached to a shirt in accordance with the present invention. FIG. 7 shows a tie attached to a shirt in accordance with the present invention. FIG. 8 shows a tie knot having a magnetic member 100 affixed therein. FIG. 9 shows a broach having a magnet member 100 affixed therein.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

The advantages of the embodiments described are numerous. Different aspects, embodiments or implementations can yield one or more of the aforementioned advantages. Many features and advantages of the present embodiments are apparent from the written description and, thus, it is intended by the appended claims to cover all such features and advantages of the invention. Further, since numerous modifications and changes will readily occur to those skilled in the art, the embodiments should not be limited to the exact construction and operation as illustrated and described. Hence, all suitable modifications and equivalents can be resorted to as falling within the scope of the invention.

What is claimed is:

1. A magnetic attachment device for releasably attaching an article to a button, said magnetic attachment device comprising:

(a) a button cover for a button, said cover comprising a cap having an unobstructed interior and an open side for receiving a button therein, and a closure plate rotatably attached to said cap about a rotational axis between an opened and closed position with respect to said open side of said cap, wherein said button cover comprises a magnetic member; and (b) an article comprising a magnetic member, wherein upon contacting said magnetic member of said article and said magnetic member of said button cover provides a magnetically attractive force which is sufficient to attach said article to said button cover.

2. The magnetic attachment device according to claim 1, wherein at least one of the magnetic members is a magnet.

3. The magnetic attachment device according to claim 2, wherein the magnet is a neodymium magnet.

4. The magnetic attachment device according to claim 2, wherein the magnet weighs about 5 grams to about 200 grams.

5. The magnetic attachment device according to claim 4, wherein the magnet weighs about 10 grams to about 50 grams.

6. The magnetic attachment device according to claim 1, wherein the magnetic members are independently selected from the group consisting of ferromagnetic materials, paramagnetic materials, and combinations thereof.

7. The magnetic attachment device according to claim 6, wherein the ferromagnetic material is selected from the group consisting of iron, nickel, cobalt, gadolinium, and combinations thereof.

8. The magnetic attachment device according to claim 6, wherein the ferromagnetic material is an iron alloy.

9. The magnetic attachment device according to claim 8, wherein the iron alloy is steel.

10. The magnetic attachment device according to claim 1, wherein the article is a tie.

11. The magnetic attachment device according to claim 10, wherein the tie is a bow tie.

12. The magnetic attachment device according to claim 1, wherein the article is a broach.

13. The magnetic attachment device according to claim 1, wherein one of the magnetic members includes a protrustion configured to receive an indentation on the other magnetic member.

14. A magnetic attachment device for releasably attaching an article to a button, said magnetic attachment device comprising:

(a') a button cover for a button secured to material by a thread-like element, said cover comprising a cap having an unobstructed interior and an open side for receiving a button therein, and a closure plate rotatably attached to said cap about a rotational axis between an opened and closed position with respect to said open side of said cap, said plate including a slot having a longitudinal axis for receiving said thread-like element, said slot opposing said cap when said plate is arranged in said closed position, said plate movable between said opened and closed position by rotation of said plate about said rotational axis in a direction transverse to the longitudinal axis of said slot, wherein said button cover comprises a magnetic member; and (b) an article comprising a magnetic member, wherein upon contacting said magnetic member of said article and said magnetic member of said button cover provides a magnetically attractive force which is sufficient to attach said article to said button cover.

15. The magnetic attachment device according to claim 14, wherein the closure plate is hinged to the cap.

16. The magnetic attachment device according to claim 14, wherein the closure plate includes a pair of spaced projections extending beyond the extent of the cap when said cap is in said closed position.

17. The magnetic attachment device according to claim 16, wherein the closure plate includes a locking element arranged between the spaced projections facing said open side of said cap, said locking element frictionally engaging an interior wall of said cap for releasably securing said plate in said closed position.

18. The magnetic attachment device according to claim 14, wherein the rotational axis of the plate and the longitudinal axis of the slot lie within a common plane when said plate is in both an opened and closed position.

19. The magnetic attachment device according to claim 18, wherein the plane containing the open side of the cap is parallel to a plane containing the slot when the plate is in the closed position.

* * * * *